US009389042B1

(12) United States Patent
Clayton

(10) Patent No.: US 9,389,042 B1
(45) Date of Patent: Jul. 12, 2016

(54) PROJECTILE LAUNCHERS

(71) Applicant: Richard A. Clayton, Simi Valley, CA (US)

(72) Inventor: Richard A. Clayton, Simi Valley, CA (US)

( * ) Notice: Subject to any disclaimer, the term of this patent is extended or adjusted under 35 U.S.C. 154(b) by 0 days.

(21) Appl. No.: 14/628,194

(22) Filed: Feb. 20, 2015

Related U.S. Application Data

(63) Continuation-in-part of application No. 14/044,856, filed on Oct. 2, 2013, now abandoned.

(60) Provisional application No. 61/708,640, filed on Oct. 2, 2012.

(51) Int. Cl.
*F41B 11/642* (2013.01)
*F41B 11/70* (2013.01)

(52) U.S. Cl.
CPC ..... *F41B 11/70* (2013.01); *F41B 11/642* (2013.01)

(58) Field of Classification Search
CPC ..... F41B 11/642
USPC ..... 42/54; 124/63–65
See application file for complete search history.

(56) References Cited

U.S. PATENT DOCUMENTS

| | | | |
|---|---|---|---|
| 115,638 | A | 6/1871 | Quackenbush |
| 122,193 | A | 12/1871 | Quakenbush |
| 126,954 | A | 5/1872 | Haviland et al. |
| 139,391 | A | 5/1873 | Horr |
| 156,890 | A | 11/1874 | Quackenbush |
| 172,376 | A | 1/1876 | Bedford |
| 178,327 | A | 6/1876 | Quackenbush |
| 182,899 | A | 10/1876 | Cross |
| 188,028 | A | 3/1877 | Quackenbush |
| 190,893 | A | 5/1877 | O'Connor et al. |
| 244,484 | A | 7/1881 | Quackenbush |
| 507,470 | A | 10/1893 | Bailey |
| 676,279 | A | 6/1901 | Schoenhut |
| 767,968 | A | 8/1904 | Stanley |
| 786,426 | A | 4/1905 | Daniels |
| 841,815 | A | 1/1907 | Quackenbush |
| 931,553 | A | 8/1909 | Allen |
| 1,052,123 | A | 2/1913 | Bennett |
| 1,114,491 | A | 10/1914 | Lefever |
| 1,240,991 | A | 9/1917 | Lefever |
| 1,310,644 | A | 7/1919 | Austin |
| 1,310,745 | A | 7/1919 | Falk |
| 1,369,401 | A | 2/1921 | Cox |
| 1,477,770 | A | 12/1923 | Roe |
| 1,545,465 | A | 7/1925 | Johnstone et al. |
| 1,633,031 | A | 6/1927 | Lefever |
| 1,692,555 | A | 11/1928 | Lewis |
| 1,761,993 | A | 6/1930 | Schmeisser |
| 1,782,664 | A | 11/1930 | Roe |
| 1,817,745 | A | 8/1931 | Forsman et al. |
| 1,830,763 | A | 11/1931 | Loomis |
| 1,856,285 | A | 5/1932 | Lefever |
| 1,868,292 | A | 7/1932 | Roe |
| 1,869,600 | A | 8/1932 | Loomis |
| 2,068,823 | A | 1/1937 | Schmeisser |
| 2,132,173 | A | 10/1938 | Lefever |
| 2,150,288 | A | 3/1939 | Moller |
| 2,151,676 | A | 3/1939 | Appleby |
| 2,214,224 | A | 9/1940 | Douglas |
| 2,237,678 | A | 4/1941 | Lohr et al. |

(Continued)

*Primary Examiner* — Reginald Tillman, Jr.
(74) *Attorney, Agent, or Firm* — Snell & Wilmer L.L.P.

(57) ABSTRACT

Projectile launchers as disclosed herein comprise a reciprocating false barrel or other forward member to cock and air pump and/or to advance a projectile magazine.

7 Claims, 6 Drawing Sheets

(56) References Cited

U.S. PATENT DOCUMENTS

| | | | | |
|---|---|---|---|---|
| 2,306,668 | A | | 12/1942 | Stevens |
| 2,453,799 | A | | 11/1948 | Lovering |
| 2,830,570 | A | | 4/1950 | Horowitz et al. |
| 2,526,305 | A | | 10/1950 | Van Blarcom |
| 2,548,984 | A | | 4/1951 | Lennberg |
| 2,580,356 | A | | 12/1951 | Martin |
| 2,587,687 | A | | 3/1952 | Beyers |
| 2,633,838 | A | | 4/1953 | Seward |
| 2,649,849 | A | | 8/1953 | Parris |
| 2,725,869 | A | | 12/1955 | Barber |
| 2,749,902 | A | | 6/1956 | Foster |
| 2,922,412 | A | | 1/1960 | Hosbach, Jr. |
| 3,111,121 | A | | 11/1963 | Baggott |
| 3,212,490 | A | | 10/1965 | Merz |
| 3,245,392 | A | | 4/1966 | Daniel |
| 3,271,033 | A | | 9/1966 | Parker |
| 3,370,581 | A | | 2/1968 | Hills et al. |
| 3,540,426 | A | | 11/1970 | Lohr et al. |
| 3,763,587 | A | | 10/1973 | Firmalino |
| 3,765,396 | A | | 10/1973 | Kienholz et al. |
| 3,818,887 | A | | 6/1974 | Akiyama et al. |
| 3,908,626 | A | | 9/1975 | Hammond |
| 4,212,285 | A | | 7/1980 | Cagan et al. |
| 4,289,109 | A | | 9/1981 | D'Andrade |
| 4,298,150 | A | | 11/1981 | Seldeen |
| 4,732,136 | A | | 3/1988 | Ferri |
| 4,843,751 | A | | 7/1989 | Ferri |
| 4,848,307 | A | | 7/1989 | Tsao |
| 5,186,156 | A | * | 2/1993 | Clayton ..... 124/59 |
| 5,242,323 | A | | 9/1993 | Rappaport |
| 5,323,755 | A | | 6/1994 | Hsieh |
| 5,373,833 | A | | 12/1994 | D'Andrade |
| 5,529,050 | A | | 6/1996 | D'Andrade |
| 5,535,729 | A | | 7/1996 | Griffin et al. |
| 5,592,931 | A | | 1/1997 | Johnson et al. |
| 5,680,853 | A | | 10/1997 | Clayton |
| 5,701,878 | A | | 12/1997 | Moore et al. |
| 5,724,954 | A | | 3/1998 | Smith |
| 5,738,079 | A | | 4/1998 | Keller et al. |
| 5,791,326 | A | | 8/1998 | Brown et al. |
| 5,797,385 | A | | 8/1998 | Thai |
| 5,944,006 | A | | 8/1999 | Moore et al. |
| 5,988,152 | A | | 11/1999 | Halter et al. |
| 6,067,975 | A | | 5/2000 | Ginn |
| 6,076,513 | A | | 6/2000 | Doherty et al. |
| 6,279,562 | B1 | | 8/2001 | Clayton |
| 6,564,788 | B1 | | 5/2003 | Hu |
| 7,287,526 | B1 | | 10/2007 | Bligh et al. |
| 7,481,209 | B1 | | 1/2009 | Bligh et al. |
| 7,677,235 | B2 | | 3/2010 | Zimmerman |
| 7,686,002 | B2 | | 3/2010 | Andrews |
| 7,686,003 | B2 | | 3/2010 | Witzigreuter |
| 8,021,208 | B2 | | 9/2011 | Victor |
| 8,146,579 | B2 | * | 4/2012 | Jablonski et al. ..... 124/65 |
| 2010/0147277 | A1 | | 6/2010 | Zimmerman et al. |
| 2012/0037135 | A1 | | 2/2012 | Dakan et al. |
| 2012/0125304 | A1 | | 5/2012 | Brooks et al. |
| 2013/0239938 | A1 | | 9/2013 | Nugent |

* cited by examiner

PROJECTILE LAUNCHERS

RELATION TO COPENDING PATENT APPLICATIONS

This patent application is a continuation-in-part of and claims priority to U.S. patent application Ser. No. 14/044,856 filed Oct. 2, 2013, which claims priority to U.S. Provisional Patent Application No. 61/708,640 filed Oct. 2, 2012, both of which are hereby incorporated by reference in their entirety.

FIELD

This disclosure is generally directed to projectile launchers in the form of air powered guns and methods and means for cocking such guns in preparation for firing and, more specially, to air guns where a spring driven plunger compresses air to discharge a projectile, and to such air guns where a movable barrel or sliding handle of the gun is manipulated by an operator to place the plunger into a condition ready for discharge.

BACKGROUND

Toy and other air guns are known to employ several types of cocking mechanisms for setting a plunger against the bias of a spring. Common mechanisms include levers below the barrel as in U.S. Pat. No. 3,540,426 (Lohr), levers above the barrel as in U.S. Pat. No. 1,692,555 (Lewis), rear slides as in U.S. Pat. No. 4,289,109 (D'Andrade), front slides as in U.S. Pat. No. 1,817,745 (Forsman et al) and simple knobs or grips directly carried on the plunger as in U.S. Pat. No. 2,580,356 (Martin).

In "break" styled guns, the stock or barrel may be hinged on the rest of the gun so that, with appropriate linkages to the plunger, the stock or barrel functions as a cocking lever. Examples are found in U.S. Pat. No. 1,633,031 (Lefever), U.S. Pat. No. 1,761,993 (Schmeisser) and U.S. Pat. No. 1,477,770 (Roe).

A cocking lever is incorporated into the trigger of other guns, as exemplified in U.S. Pat. No. 5,535,729 (Griffin) and U.S. Pat. No. 2,237,678 (Lohr). A cocking slide may likewise be incorporated in the trigger of a gun as in U.S. Pat. No. 5,797,385 (Thai).

In "sliding barrel" or "reciprocating barrel" styled guns, a barrel assembly may be mounted to the gun body for linear travel, whereby pushing or pulling the barrel sets a plunger against the bias of a spring. Examples are found in U.S. Pat. No. 178,327 (Quackenbush), U.S. Pat. No. 767,968 (Stanley), U.S. Pat. No. 5,724,954 (Smith) and U.S. Pat. No. 5,791,326 (Brown).

Holsters have been developed wherein the holster engages an actuating handle of a gun so that the gun may be cocked by pressing it downward in the holster. Examples are found in U.S. Pat. No. 3,763,587 (Firmalino), U.S. Pat. No. 4,298,150 (Seldeen) and U.S. Pat. No. 7,481,209 (Bligh).

SUMMARY

Projectile launchers as disclosed herein comprise a novel cocking and/or advancement apparatus, similar to a sliding or reciprocating barrel type arrangement that can be employed in the construction of toy air guns. In particular, the cocking and/or advancement apparatus as disclosed herein may be employed in the construction of multiple-shot toy air guns that can be easily manipulated for cocking, advancement and firing, all by a single hand of the user, without the use of a specialized holster or other additional equipment, so that a user could, if desired, simultaneously operate guns with each hand. Projectile launchers as disclosed herein may also be configured for being conveniently and efficiently cocked and/or advanced by holding the gun body in one hand and pressing the barrel or similar cocking handle into the palm of the other hand.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

These and other features and advantages of projectile launchers as disclosed herein will be appreciated as the same becomes better understood by reference to the following detailed description when considered in connection with the accompanying drawings wherein.

DETAILED DESCRIPTION

Figure 1:
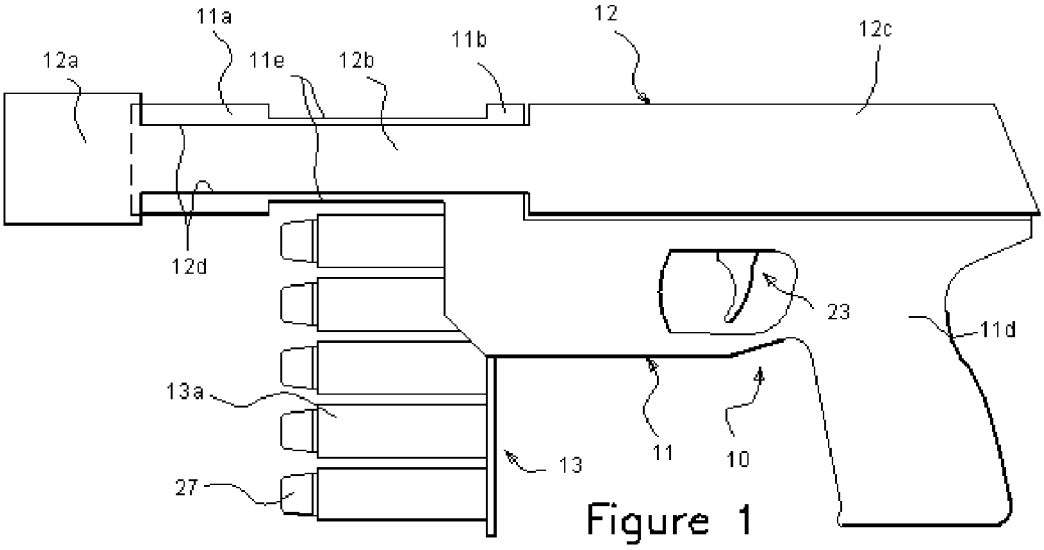
FIG. 1 is a side view of a "clip load" styled projectile launcher as disclosed herein.
Figure 3:
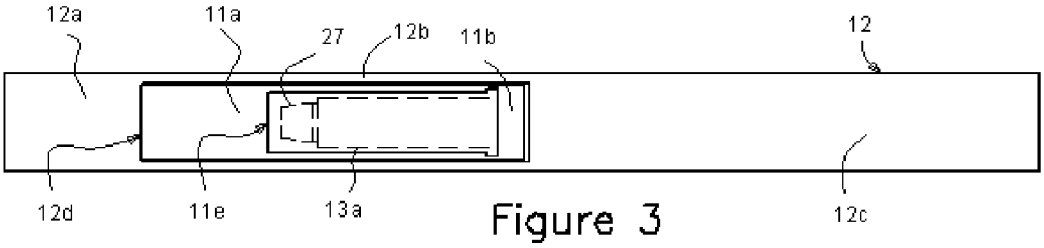
FIG. 3 is a top view of the projectile launcher of FIG. 1.
Figure 4:
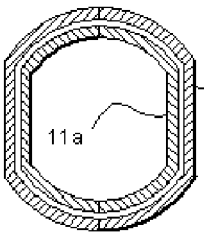
FIG. 4 is a sectional view of the projectile launcher of FIG. 6, taken in the direction of arrows 4-4.

FIGS. 1 through 8 illustrate a projectile launcher in the form of a toy air gun 10 (or components thereof) having a frame, body or housing 11 and a slide assembly 12. The slide assembly 12 is movably mounted on the frame 11, as may be understood by comparing FIGS. 1 and 2. In FIG. 1, the slide 12 is in a normal or forward position, and in FIG. 2 the slide has been moved to a rearward or cocking position with respect to the frame 11. With reference to FIG. 4, it may be seen that the front end 12*a* of the slide is a hollow false barrel that slides on the exterior of a slightly smaller false barrel 11*a* at the front end of the frame. The front end of the sliding false barrel 12*a* serves as a handle for cocking of the gun. The slide further comprises a midsection 12*b* and a rearward section 12*c* that likewise are carried for movement, generally on the exterior of the frame 11. The false barrels 11*a* and 12*a* are intended to visually simulate a barrel structure of a gun, but do not significantly contain, guide or control the discharge of compressed air that launches a projectile. The depicted false barrel structures include walls that completely encircle or surround an axis of projectile discharge, but other false barrel structures may only partially encircle or enclose such an axis. A projectile passing between the walls of all such structures is considered to pass through the false barrel.

The gun 10 is adapted to operate with a magazine 13, which comprises several launch tubes or "true barrels" 13*a* joined together by a flat plate 13*b*. In addition to supporting and joining the barrels 13*a* to one another, the plate 13*b* interfaces with guides 14 and with an advancement actuator 15 on the frame 11, visible in FIGS. 5 and 6. Breech cutouts or slots 11*e* and 12*d* are provided in the frame and slide, respectively, to allow passage of the magazine. The upper slots 11*e* and 12*d* may be better understood with reference to FIG. 3, which depicts a top view of the gun with the slide 12 in its normal, forward position ("forward" being used in a conventional sense in general reference to the direction in which the gun is pointed for launching projectiles). Note that the slots 12*d* in the slide extend farther forward than the slots 11*e* in the frame. This compensates for movement of the slide toward the projectiles 27 and barrels 13*a* during a cocking operation. As depicted, the projectiles 27 are carried inside the launch tubes 13*a*, but projectiles may be carried on and launched from the exterior of a magazine barrel/launch tube as well, as well known in the art.

The advancement actuator 15, a pawl in this instance, is part of an advancement mechanism that further includes a lever 16 pivoted on a post 16*a* inside the frame 11. The pawl 15 is pivoted at one end of lever 16 about a post 15*a*. The other end of the lever 16 is positioned to engage a post 17 that protrudes from the slide midsection 12*b*, through a slot 18 to the interior of the frame. Another protruding member or flange 19 of the slide 12 extends toward an opening at frame edge 20 to engage a flange 21*a* of a plunger 21. The plunger further includes a tubular body 21*b* and a piston or head 21*c*. The piston is movable to compress air within a cylinder 22. The cylinder includes a nozzle or outlet 22*a*, through which compressed air can be discharged.

A trigger assembly 23 is pivoted about a post 23*a* within the frame. The trigger includes a finger grip 23*b*, a latch 23*c* and a lever arm 23*d*. The lever arm extends inside the plunger tube 21*b* through slots 21*d*. A spiral spring 24 is captured within the plunger tube, between the lever arm 23*d* and the piston 21*c*.

Figure 5:
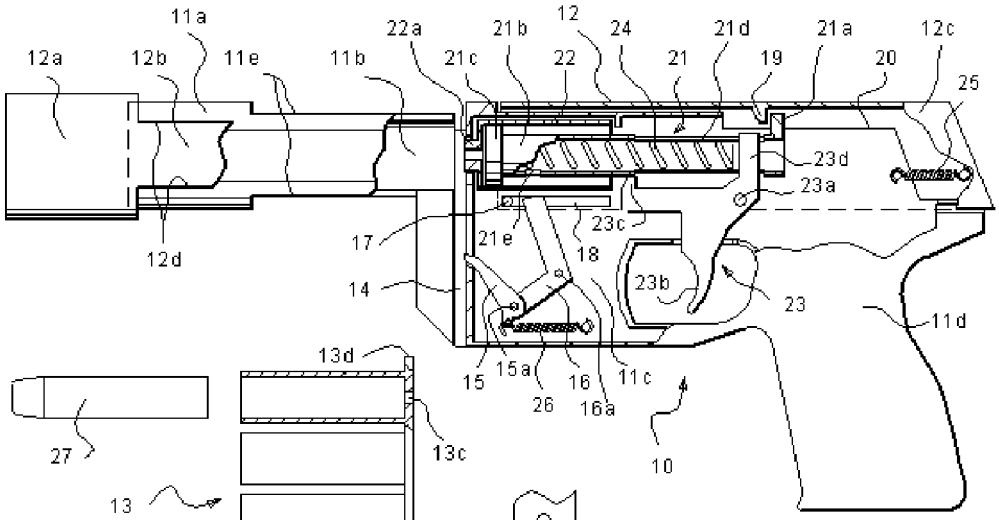
FIG. 5 is a side view of the projectile launcher of FIG. 1 in partial section.
Figure 7:
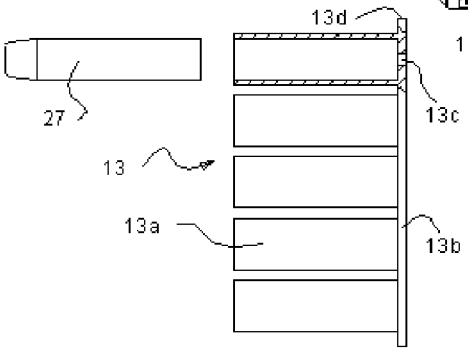
FIG. 7 is a side view in partial section of a magazine or "clip" used with the projectile launcher of FIGS. 1, 2, 5 & 6.
Figure 8:
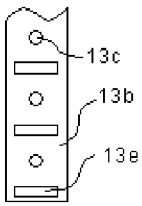
FIG. 8 is a partial rear view of the magazine of FIG. 7.

The outlet 22*a* of the air cylinder extends through an opening from the rear section 11*c* of the frame to the mid-section 11*b* to engage the back plate 13*b* of a magazine appropriately positioned in guide slots 14. Each barrel of the magazine includes a passage 13*c* through which pressurized air from the cylinder outlet may be received when the barrel is aligned in "firing position". The air cylinder 22 is loosely mounted within the frame 11, so when the plunger 21 is in its normal discharged position, as depicted in FIG. 5, the plunger pushes the cylinder 22 slightly forward. As a magazine is inserted into the guides 14, it will be stopped when its upper edge 13*d* contacts the bottom of the nozzle 22*a*, which extends slightly into the area of guides 14. During a cocking operation, the plunger moves rearward, so the air outlet is no longer pushed forward and is able to move out of the way of the magazine.

Figure 2:
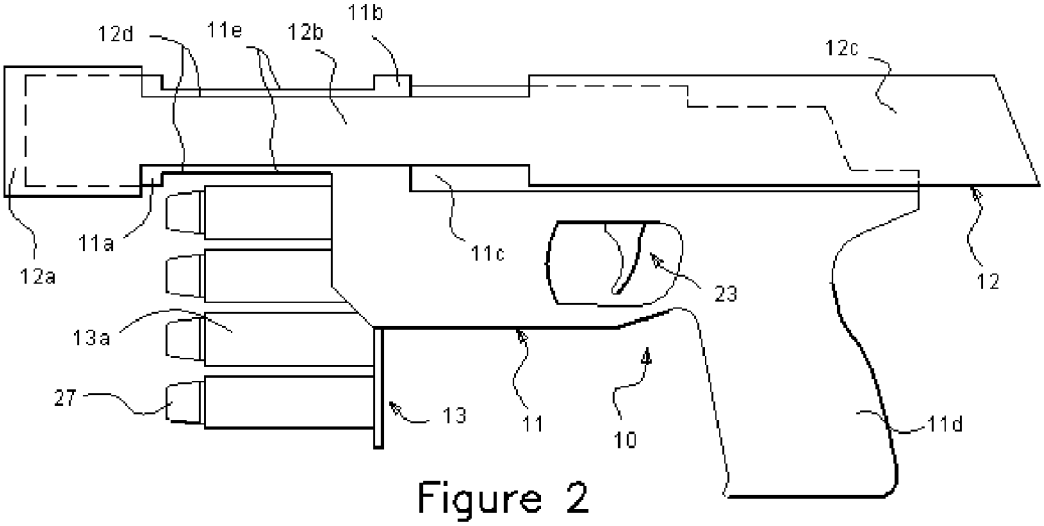
FIG. 2 is a side view of the toy gun of FIG. 1, in which the cocking slide is in a rearward position.
Figure 6:
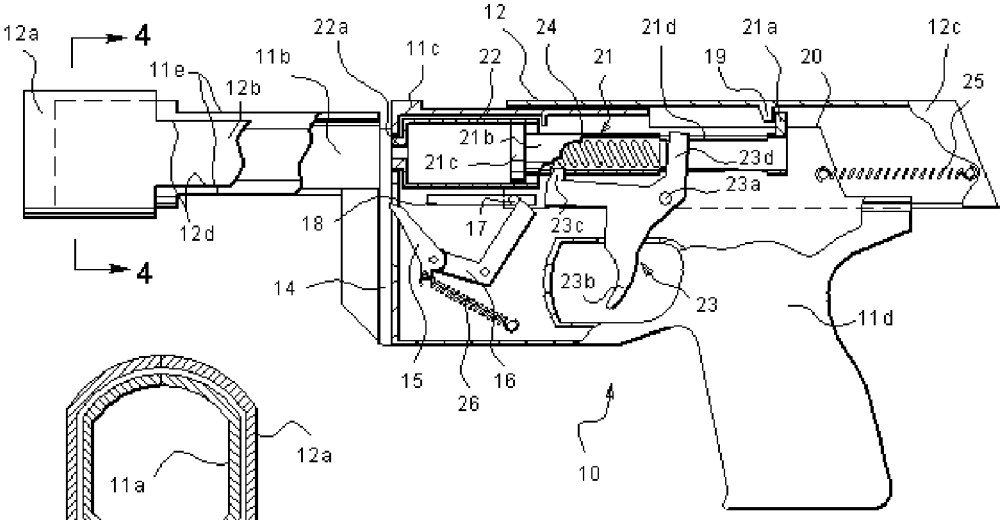
FIG. 6 is a side view of the projectile launcher of FIG. 2 in partial section.

To prepare the gun for firing, the slide 12 is moved from the normal position shown in FIGS. 1 and 5, to the cocking position shown in FIGS. 2 and 6, and then returned to the normal position. An operator, using one hand to hold the gun by its pistol grip 11*d*, may elect to grasp the rear section 12*c* of the slide and pull it back, or he may elect to press the forward end 12*a* of the slide against his other hand or against any other relatively stationary object or surface. It is preferable to adapt the front-most extremity of portion 12*a* to comfortably spread out the force applied to a user's hand when so pressed, for example by making the cross-section of the extremity relatively broad and/or by including a resilient covering, or to otherwise adapt the extremity for stable engagement with other objects or surfaces it may be pressed against, and to avoid concentrating the applied force in a small area whereby the object or surface might be penetrated or damaged. In the present example such adaptation is accomplished by constructing the muzzle of the false barrel 12*a* with a relatively wide diameter and generally flat front surface. The styling may of course be varied, but it is desirable that the surface area available for engagement be appropriate, with respect to such factors, for the amount of force necessary to actuate a given launcher.

In the cocking position, the front end 12*a* of the slide remains even with or forward of the frame end 11*a*, ensuring that the full range of operative motion may be traversed when the slide end 12*a* is pressed against a flat surface. Note that the provision of a secondary handle at the rear section 12*c* of the slide is an optional feature and not essential to the projector launcher as disclosed herein in its basic form. Movement of the slide to its cocking position draws the plunger 21 rearward via engagement of slide flange 19 with plunger flange 21*a*. As the plunger moves rearward the spring 24 is compressed between the piston 21*c* and the trigger's lever arm 23*d*, urging the trigger assembly to rotate in a clockwise direction with respect to the Figures. When the plunger reaches its rearmost position, the trigger latch 23*c* will engage an opening 21*e* on the plunger body. When the slide returns forward, as urged by a spring 25, the latch will retain the plunger in its rearward, cocked position.

Additionally, as the slide is drawn from its normal position to its cocking position, the advancement lever 16 will be rotated clockwise by movement of post 17 of the slide from left to right in slot 18 of the frame. Rotation of the lever causes the pawl 15 to engage an index slot 13*e* in the magazine plate 13*b*, advancing a barrel 13*a* into alignment with the air outlet 22*a*. A spring 26 returns the advancement lever 16 and pawl 15 to their normal positions when the slide 12 is released. The gun is now ready for firing and a projectile 27 may be discharged by pulling the trigger grip 23*b* to release the plunger, thus completing an operational cycle of the launcher.

The particular types and arrangements of the air pump, advancement mechanism, trigger, latch and slide are depicted for convenience of illustration, but any effectively similar mechanisms of known or unknown type may be used as well. For example, the air pump may include a cylinder having an outlet, and a piston that moves within the cylinder, or it may include a hollow piston having an air outlet, and a cylinder that moves on the exterior of the piston. Further, the air outlet may be remotely located and connected to the compression members of a pump though suitable conduit. Magazines may take the form of straight arrays, cylinders or belts, etc., and may include multiple launching tubes or may feed stacked projectiles to a single launch tube. Advancement mechanisms might be of a levered pawl type, as illustrated, or of other types known and unknown in the art. For example, an advancement mechanism might employ a "twisted strip" reciprocated within a slot, or might employ a linearly reciprocated cam engaging zigzag indexing slots or ramp-like protrusions on a movable magazine, etc. Rather than moving projectiles and/or launch tubes on the launcher, an advancement system may use mechanisms to variably direct an air pump discharge to particular projectiles and launch tubes as they are selected, such launch tubes being fixed in position relative to one of the launcher's reciprocating portions.

References herein to "automatic" or "automatically" generally indicate tasks or functions that occur during normal operation of a device, typically as a secondary action linked to a primary action. For example, grasping a projectile magazine and moving it to a new orientation, or tilting a launcher to roll a projectile into place would be considered manual advancement of projectiles, at least in part, whereas the full and complete advancement of a projectile via cooperative linkage to a trigger or a cocking actuator would be considered automatic in the sense that it is normally accomplished as a byproduct of discharging or cocking of the air pump, without additional action required of the user. An actuator that returns to a rest position due to tensioning of a spring during manual movement away from that position would be considered to return automatically.

A reciprocating barrel or similar actuating assembly as used with projectile launchers as disclosed herein is preferably of a linearly sliding type, but curvilinear guides or pivoted linkages may also be employed so that the assembly in operative motion reciprocates through a curvilinear or arcuate path including a linear component. Purely pivoting structures such as a "break barrel" or a hinged stock are not considered or construed to be such a reciprocating assembly in the context of this application.

It may be desirable in some embodiments to utilize the slide assembly only for cocking an air pump, or only for advancing a magazine, with the remaining function being facilitated through other means. For example, the slide 12 might cock the air pump 21, 22 while a trigger might actuate lever 16 either before or after releasing the plunger 21, or the magazine 13 might be advanced manually by a user, thereby reducing parts by eliminating lever 16, pawl 15 and spring 26. As another example, the magazine 13 might be advanced by the slide assembly 12, while the piston might be cocked and released by a sliding trigger.

Figure 9:
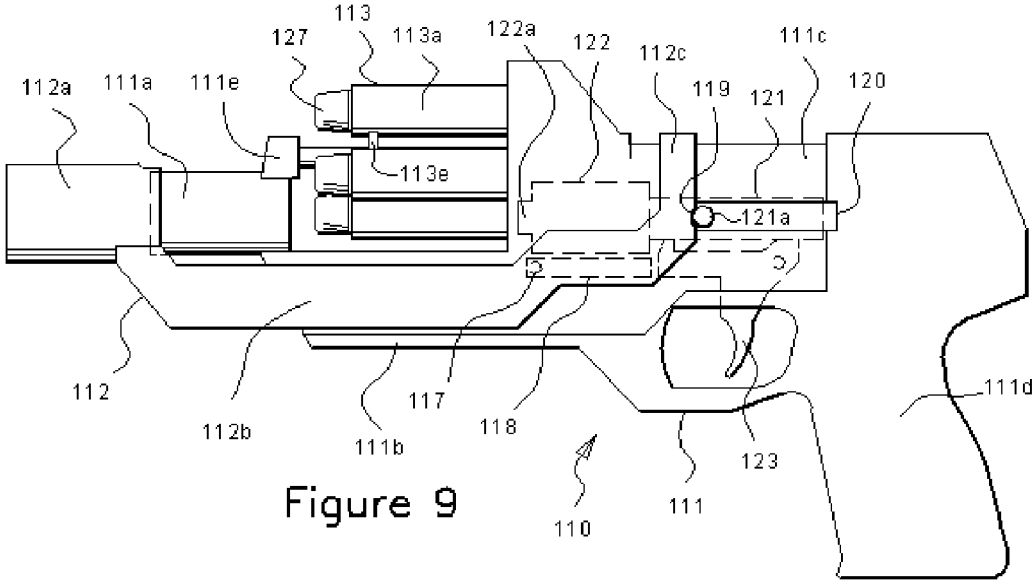
FIG. 9 is a side view of a projectile launcher as disclosed herein.
Figure 10:
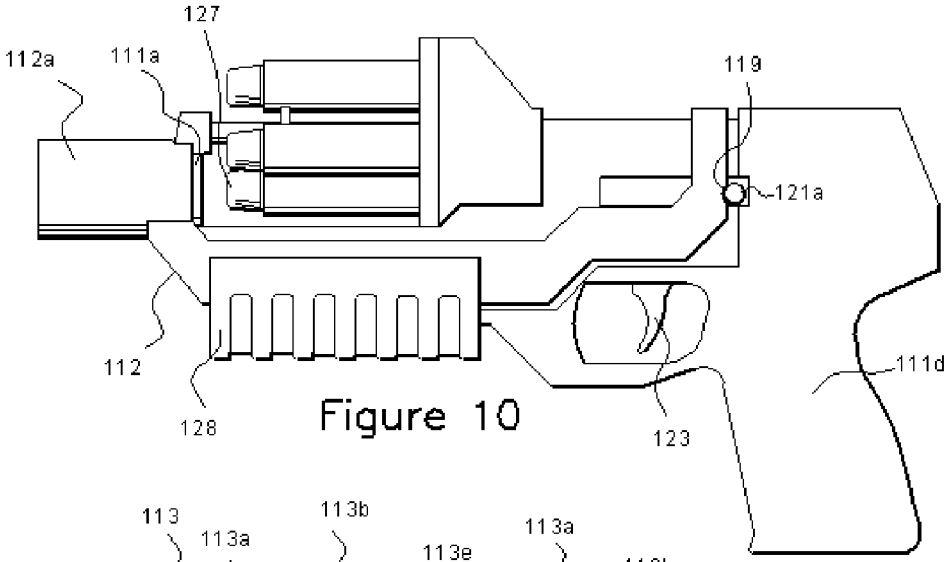
FIG. 10 is a side view of a projectile launcher similar to that of FIG. 9, in which the cocking slide is in a rearward position, and incorporating an optional secondary cocking handle.
Figure 11:
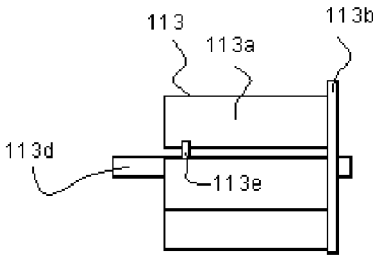
FIG. 11 is a side view of a magazine employed in the projectile launcher of FIGS. 9 & 10.
Figure 12:
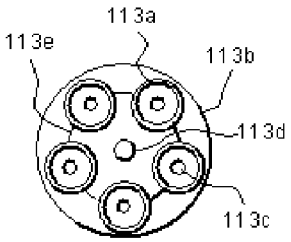
FIG. 12 is a rear view of the magazine of FIG. 11.

FIGS. 9 to 12 depict another embodiment projectile launcher as disclosed herein in the form of a toy air gun. The air gun 110 has a frame, body or housing 111, a slide assembly 112 and a rotary magazine 113. The slide assembly 112 is movably mounted on the frame 111, as may be understood by comparing FIGS. 9 and 10. In FIG. 9, the slide 112 is in a normal or forward position, and in FIG. 10 10 the slide has been moved to a rearward or cocking position with respect to the frame 111. The front end 112*a* of the slide is a hollow false barrel that slides on the exterior of a slightly smaller false barrel 111*a* at the front end of the frame. The front end of the sliding false barrel 112*a* serves as a handle for cocking of the gun. The slide further comprises a midsection 112*b* and rear section 112*c* that likewise are carried for movement, generally on the exterior of the frame 111. The magazine 113 is carried for rotation on the frame via engagement of a post 113*d* and mating receptacles 111*e* of the frame. As illustrated in FIGS. 11 and 12, the magazine further comprises a plurality of launching tubes 113*a*, a front support 113*e*, a rear support plate 113*b*, and a plurality of passages 113*c* connecting the interior space of the launch tubes to the back side of the rear support plate. The back side of the rear support plate 113*b* is provided with indexing features (not illustrated) adapted to work with a corresponding advancement mechanism, for appropriate advancement and alignment of the launch tubes.

Carried upon or within the frame are an air pump, comprising a plunger 121 and an air cylinder 122, and a trigger 123. Operation of the air pump and trigger are essentially the same as for the similar elements of the previously described gun 10. A driving surface 119 of the rear slide section 112*c* releasably engages posts 121*a* on the sides of the plunger 121, which protrude through and are guided by slots 120 in the rear frame 111*c*. Also carried within the frame is a magazine advancement mechanism (not illustrated) capable of translating linear motion of the slide into rotational movement of the magazine, such that for each operative reciprocation of the slide, a different barrel 113*a* will be moved into firing alignment with the air pump outlet 122*a*. The advancement mechanism may be of any effective form, known or unknown, but will preferably be similar to one of many simple and effective types known in the art. The advancement mechanism may be actuated through suitable engagement with a member of the slide such as a post 117 extending to the frame interior through slots 118 of frame section 111*c*. Engagement of the slide to the advancement mechanism might also be accomplished through intermediate linkages such as, but not limited to, a member of the plunger 121.

To cock the plunger and advance the magazine, an operator holds the pistol grip 111*d* in one hand and presses the false barrel 112*a* of the slide against his second hand or any relatively stationary object, to move the slide from the normal position of FIG. 9 to the rearward, cocking position of FIG. 10. Engagement of the slide surface 119 to the plunger posts 121*a* drives the plunger rearward, compressing a spring within the plunger tube as described for the embodiment 10, and latching the plunger to the trigger, also as previously described. Simultaneously, the magazine advancement mechanism is actuated via post 117 or other suitable linkage to bring a next barrel into firing alignment. The slide 112 is then returned to its normal position, either manually or by incorporation of a spring for that purpose. Pulling the trigger 123 will release the plunger to compress air, for the discharge of a projectile 127 and completion of an operational cycle.

With reference to FIG. 9, it may be observed that the slide and frame are both formed with what can be termed a "cut-out" or breech at their mid-sections 112*b* and 111*b*, respectively, whereby the mid-sections are offset from the axes of the false barrels and the air outlet 122*a*. The cut-out areas allow the magazine 113 to be positioned on the frame for alignment of a selected launch tube with the false barrels 112*a* and 111*a* of the slide and frame, respectively, and with the air outlet 122*a*. The term "breech" as used herein varies somewhat from the usage for a traditional firearm. In a firearm, the breech generally refers to an opening or the like for loading a projectile or cartridge into the rear of a true barrel. As applied herein to embodiments of projectile launchers as disclosed herein, "breech" refers to an opening, port, open area or similar structure of the projectile launcher, adapted and intended to allow access for passage or placement of a projectile into a firing position or alignment in the launcher, but does not necessarily imply insertion of the projectile into the rear of a true barrel. In presently preferred embodiments, the true barrel(s) or launch tube(s) employed herewith will be muzzle loaded and include a muzzle that is positioned within a breech of the overall launcher during firing or at least during a portion of the cocking or advancement operations. In such embodiments the forward end of a false barrel or similar forward actuator does not itself include or support a muzzle of a true barrel; instead the muzzle of the true barrel(s) is/are able to move into and out of a breech of the overall launcher to facilitate advancement of projectiles to firing position. Similar single shot embodiments may be constructed in which a single muzzle loaded true barrel or launching tube is moved between a loading position and a firing position within a breech to facilitate manual passage of a projectile into firing alignment.

Note that the mid and rear sections 112*b,c* of the slide are depicted in the Figures as moving on the outside of the frame, but they could be suitably designed to travel within the mid and rear sections 111*b,c* of the frame instead. Likewise, with minor modifications to the frame and slide, the false barrel 112*a* of the slide could be designed to travel within the false barrel 111*a* of the frame instead of on its exterior.

As illustrated in FIG. 10, an optional secondary cocking handle 128 may be provided at the mid-section 112*b* of the slide. The secondary handle may yield additional attractiveness or play value in the toy and allows a user to cock the gun either by pressing the barrel as described above, or by a more traditional "pump" action.

Figure 13:
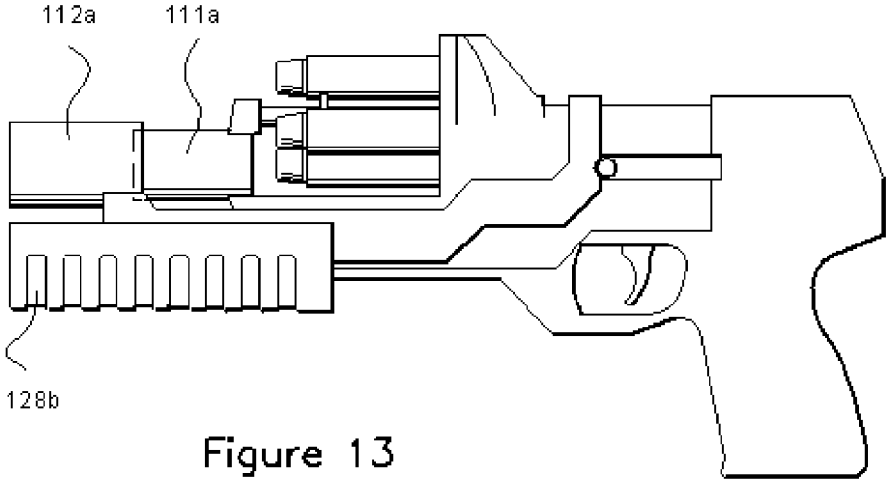
FIG. 13 is a side view of a projectile launcher similar to that of FIG. 10, wherein the front end of an optional secondary handle is extended to be even with a front end of a false barrel of the cocking slide.
Figure 14:
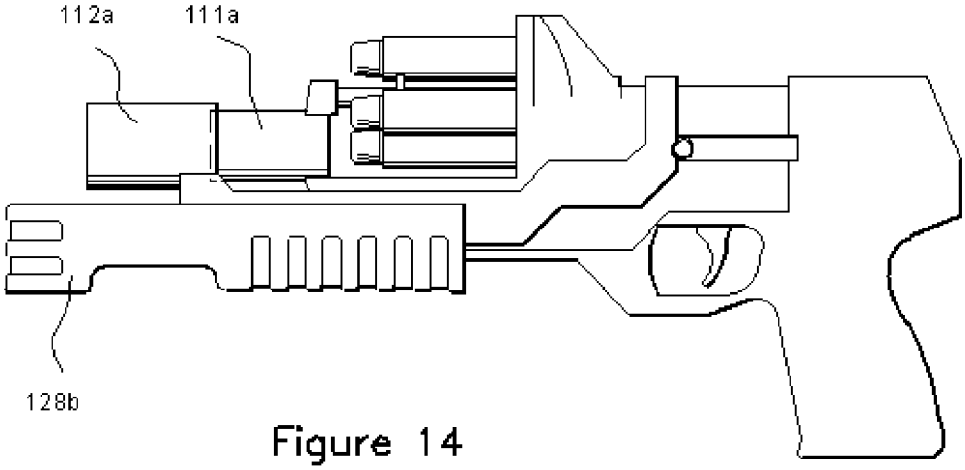
FIG. 14 is a side view of a projectile launcher similar to that of FIGS. 10 & 13, wherein a front end of a secondary cocking handle is extended farther forward, past a front end of a false barrel of a cocking slide.

The secondary handle 128 can be modified to extend in length to the front end of the slide false barrel 112*a*, as shown in FIG. 13, or beyond the end of false barrel 112*a* as shown in FIG. 14. In both Figures, the slide 112 is in its normal, forward position. The gun may thus be cocked by pressing the extended handle 128*b/c* against whatever surface the false barrel 112*a* would otherwise normally be pressed against. The modifications of FIGS. 13 and 14 are essentially aesthetic as they offer no additional cocking functionality beyond that afforded by the false barrel 112*a* and handle 128 of FIG. 10. Furthermore, while the false barrels 112*a* and 111*a* of FIGS. 13 and 14 would provide a convenient bearing and guide structure for the extended handles 128*b* and 128*c*, those functions could be addressed at the mid-sections of the frame and slide, and the sliding false barrel 112*a* and/or the fixed false barrel 111*a* could be eliminated. In such a construction the frame and slide structures define an open area bounded on the right by the magazine's rear interface to the frame and bounded on the left by the front of the handle 128*b*. A projectile and barrel passing into their firing positions must enter a portion of that open area to become aligned with nozzle 122*a* of the air pump, and so the portion of that open area utilized to accommodate a selected barrel and projectile would constitute a breech, or a portion of such a breech, for passage of projectiles and launch tubes into their firing positions.

Figure 15:
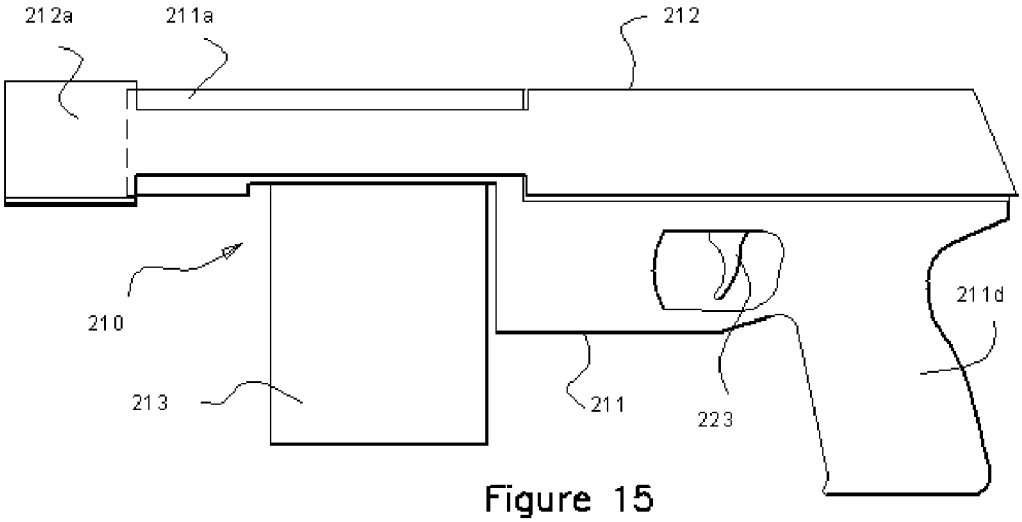
FIG. 15 is a side view of a projectile launcher as disclosed herein with a spring biased magazine.
Figure 16:
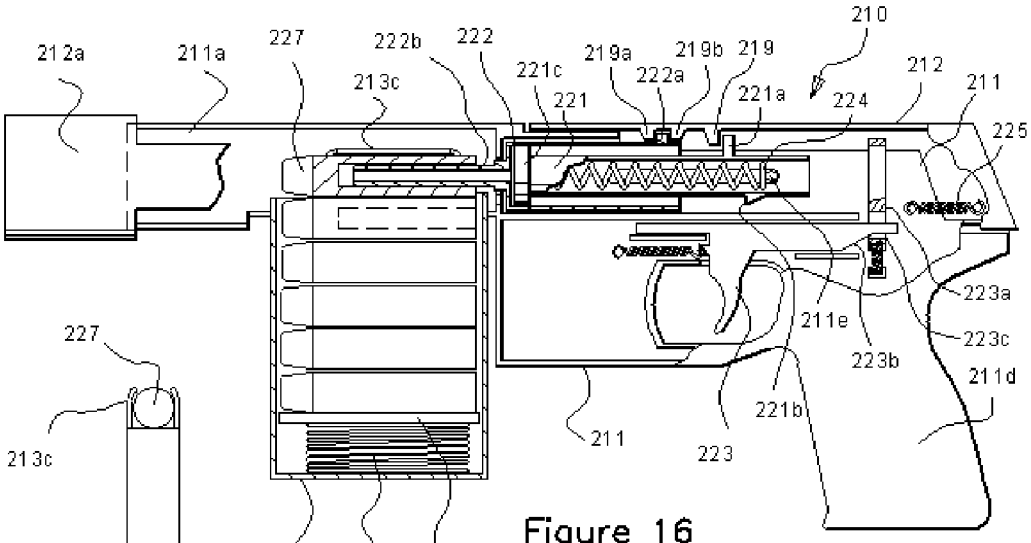
FIG. 16 is a side view in partial section of the projectile launcher of FIG. 15.

FIGS. 15 and 16 illustrate another embodiment projectile launcher as disclosed herein, wherein a spring loaded magazine is advanced through actuation of a sliding barrel. The toy gun 210 has a frame, body or housing 211, a slide assembly 212 and a removable spring fed magazine 213. Carried for horizontal travel within the gun body is an air pump comprising a cylinder 222 and a plunger 221. Also carried for movement on the gun body are a horizontally sliding trigger 223 and a vertically sliding latch 223*a*.

Figure 17:
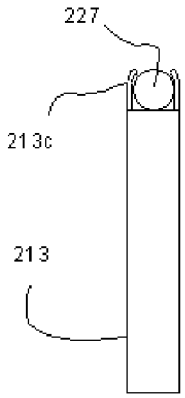
FIG. 17 is a front view of the projectile magazine employed in the projectile launcher of FIGS. 15 and 16.

The magazine 213 comprises a hollow rectangular box having an interior chamber adapted and sized to hold a stack of projectiles 227. A spring 213*a* biases a platform 213*b* upward. The projectiles are in turn biased upward by the platform. A pair of inwardly arched tabs 213*c* at the top of the magazine stops upward movement of the projectiles. The projectiles 227 are preferably made of a resilient material so that they may be pressed through the gap between tabs 213*c* to load the magazine. The bias of spring 213*a* is relatively light, so that it can't push the projectiles back out through the gap. FIG. 17 depicts a front view of the magazine. Breech openings in the undersides of false barrels 211*a* and 212*a* allow clearance or passage for the projectile holding magazine 213 and allow for passage of projectiles 227 into firing position. The magazine 213 can be removably mounted or permanently attached. If permanently affixed, the open top area 213*c* functions as a breech adapted for similar passage of projectiles.

To cock the air pump and advance the magazine, the slide 212 may be actuated by placing the slide's forward end 212*a* against a stationary surface and pushing the gun forward via pistol grip 211*d*, so that the false barrel 211*a* of the frame slides forward within the false barrel 212*a* of the slide. Relative motion between the gun body 211 and slide 212 results in a projection 219 of the slide engaging a tab 221*a* of the plunger 221, such that the plunger is moved rearward to engage the latch 223*a*. A spring 224 biases the plunger toward its forward rest position. The spring is carried within the plunger and one end engages the plunger head 221*c*, while the other end engages a post 211*e* affixed to the gun body 211. Slots 221*d* on the hollow plunger 221 allow it to travel over the post 211*e*. Another slide projection 219*a* engages a tab 222*a* on the air pump cylinder, to draw the cylinder 222 rearward as the gun is cocked. The air cylinder includes a tubular forward extension 222*b* adapted to mate with the interior of a projectile 227 contained within the magazine 213. Prior to the gun being cocked, the topmost projectile in the magazine will rest against the bottom of the extension 222*b*. When the air cylinder is drawn rearward to its fullest extent, the extension 222*b* will be drawn rearward of the breech area and out of engagement with the projectile, and the projectile will be moved upward by force of spring 213. Tabs 213*c* at the top of the magazine hold the projectile in axial alignment with the air cylinder forward extension. When the slide 212 is released from external bias, a spring 225 moves it forward relative to the gun body. As the slide returns to its normal forward position, a third slide projection 219*b* moves the air cylinder forward, and the extension 222*b* slides into the hollow interior of the projectile. In this construction, extension 222*b* is the actual launch tube or true barrel from which a projectile is launched.

With the plunger latched rearward against the bias of spring 224, the cylinder 222 in its forward position and a projectile mated to the cylinder forward extension 222*b*, the gun may be discharged by sliding the trigger 223 rearward. The sloping rear end 223*b* of the trigger engages a hole 223*c* in the latch. As the trigger moves rearward, the sloped face 223*b* forces the latch downward to disengage the latch from a hook 221*b*, releasing the plunger. The spring 224 drives the plunger forward to compress air within the cylinder 222. Pressurized air is channeled through tubular extension 222*b* to launch the mounted projectile, thus completing an operational cycle of the launcher.

It is noted that FIGS. 15-17 illustrate only the basic features of a spring fed magazine system. In practice, other features may be added to hold the upper projectile in place as the cylinder extension 222*b* is inserted and to separate the projectile from those below it. The extension 222*b* may be configured with a tube that surrounds the projectile, in addition to or in place of the internally inserted tube depicted. A releasable latch may be employed to hold the magazine in proper engagement to the gun. Furthermore, the magazine may be non-removably incorporated into the body of the gun, with a port provided in the body to allow insertion of projectiles into the magazine.

Figure 18:
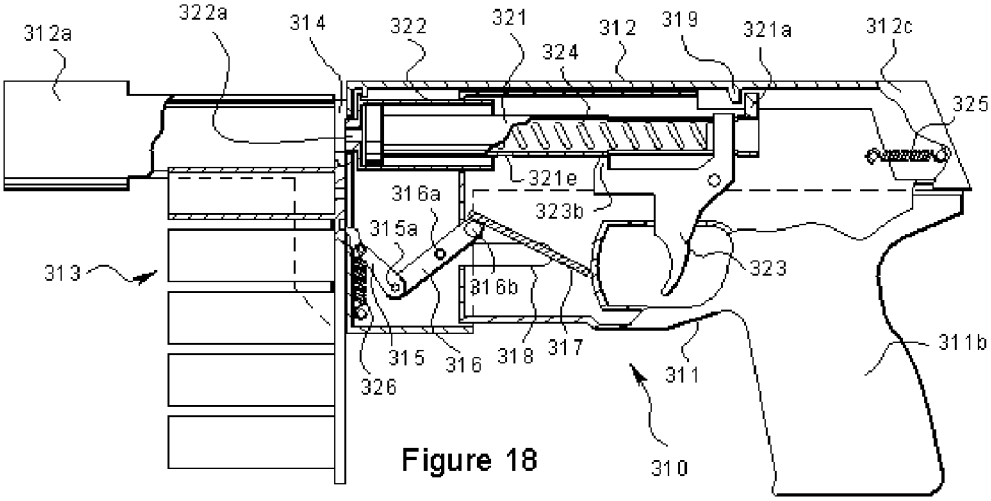
FIG. 18 is a side view in partial section of a projectile launcher as disclosed herein, and in which a magazine is carried on a barrel portion or "slide assembly"
Figure 19:
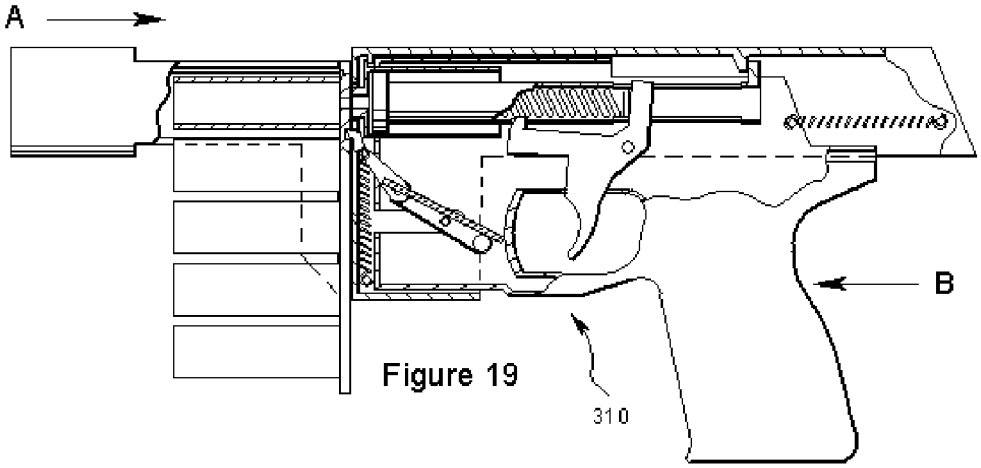
FIG. 19 is a side view of the projectile launcher of FIG. 18, wherein the slide assembly and the body portions are compressed for cocking and advancement.
Figure 20:
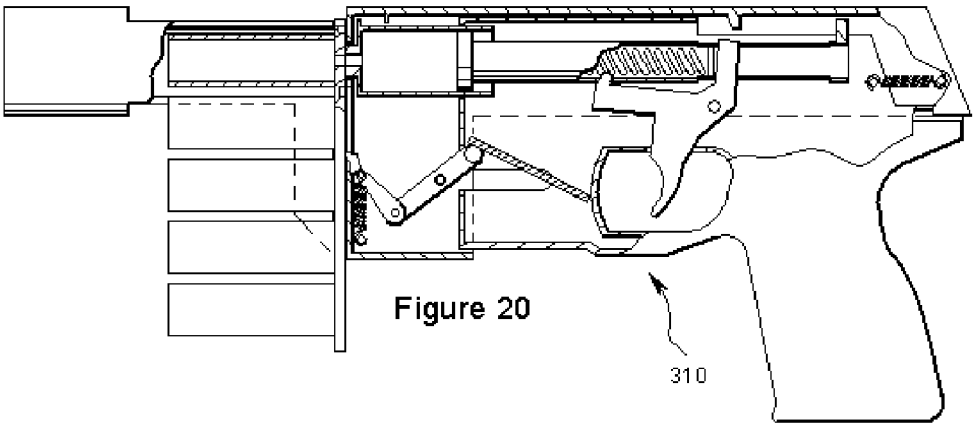
FIG. 20 is a side view of the projectile launcher of FIG. 18 in a cocked and advanced condition.

FIGS. 18 to 20 illustrate an embodiment projectile launcher as disclosed herein in which a projectile magazine is carried on the barrel/slide portion of the toy gun, as opposed to the previously illustrated embodiments in which the magazine is carried on the frame/handle portion. The toy gun 310 has a frame or handle portion 311, and a barrel or slide assembly portion 312. The portions 311 and 312 are mated in a sliding relationship that allows the two portions to be moved relative to one another to facilitate cocking of an air pump (321, 322, 324) and advancement of a projectile magazine 313. The air pump comprises a plunger 321, an air cylinder 322 and a spring 324. The magazine 313 is movably carried on the barrel portion 312, retained by and traveling in a pair of channels 314. A lever 316 and pawl 315 are employed as members of a mechanism for advancing the magazine 313. The lever 316 is pivoted about a post 316*a* on the lower midsection of the slide assembly 312. The pawl 315 is pivoted about a post 315*a* on the forward end of the lever 316.

Cocking and advancement are initiated by sliding the gun's front and rear portions (312 and 311) toward each other, as indicated by arrows A and B in FIG. 19. This may be accomplished by pushing the false barrel 312*a* toward the gun body or by pulling on the rear part of the slide 312*c*, while pushing pistol grip 311*b* in the opposite direction. A slot 318 in frame 311 allows passage of the lever's pivot post 316*a* as the frame 311 and slide 312 are pressed together.

General functionality of the advancement mechanism is similar to that previously described for the embodiment of FIGS. 1 to 8 except that the magazine, advancement lever and pawl are mounted on the slide assembly portion rather than the body portion. As the slide 312 moves toward the body 311, a post 316*b* on the lever 316 engages a ramp 317 that is a member of body 311. The ramp 317 is a part of the left side of the body ("left" being used in a normal sense to describe a user's view when holding the gun by pistol grip 311*b* and pointing the gun away from his/herself). The left side is mostly cut away in the drawing; the ramp protrudes from said left side into the body's interior. The lever 316 and pawl 315 pass to the "user's right" of the ramp inside the body, while the post 316*b* engages the ramp and is forced downward as the front and rear portions (312 and 311) of the gun are forced together, as in FIG. 19. The pawl 315 engages the magazine and forces it upward as lever 316 rotates clockwise about 316*a* in response to downward motion of post 316*b*.

Simultaneously with the magazine advancement operation, a projection 319 on slide assembly 312 engages a projection 321*a* of the plunger, to draw the plunger rearward with respect to the body 311 and trigger 323. When the gun members reach the relative positions of FIG. 19, the plunger orifice 321*e* becomes aligned and engaged with the trigger's latch member 323*b*. The air cylinder 322 travels with the slide assembly 312, so when the user releases the slide assembly, the slide and air cylinder are returned forward, with respect to the body 311, by a spring 325. Another spring 326 returns the advancement lever and pawl 316, 315 to their rest positions. The gun 310 will then be in a cocked condition, and the magazine will have advanced by one launch tube, as depicted in FIG. 20.

As has been previously discussed, details and types of air pumps, advancement mechanism, magazines and other components have been depicted for convenience of illustration, but other types may be readily substituted and are understood to be within the scope of projectile launchers as disclosed herein. A spring-loaded magazine may similarly be deployed on the barrel or slide assembly portion of air guns as disclosed herein, as opposed to being on the frame or body portion. Some adjustment would be made in such case to facilitate effective advancement of projectiles. For example the launch tube might be made movable relative the sliding false barrel so as to be latched rearward as the false barrel is returned forward, thereby allowing passage of a next projectile into firing alignment. As the false barrel nears forward position, the latch will be released to allow a spring bias to return the launch tube forward to receive the projectile.

While all embodiments herein depicted and described utilize systems in which the slide assemblies and gun bodies must be returned to rest positions prior to discharge, other embodiments of projectile launchers as disclosed herein may incorporate systems wherein a false barrel or similar actuator returns to its rest position during or after discharge. For example a false barrel may be designed to spring forward with a plunger during firing, or a false barrel or similar forward actuator might be released from a latched condition following discharge, to be returned by a separate biasing element.

Although only a few example embodiments have been described in detail above, those skilled in the art will readily appreciate that many modifications are possible in the example embodiments without materially departing from the concepts as disclosed herein. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. An air operated projectile launcher comprising:

a first portion adapted for reciprocating travel between a first position and a second position relative to a second portion, said travel including at least a linear component, movement from said first position to said second position relatively moving an extremity of said first portion toward said second portion;

the second portion including all members of the launcher that the first portion extremity moves relative to when traveling from the first position to the second position with respect to the linear component of travel;

an air pump having a cocked state and a discharged state, said air pump biased toward said discharged state;

said second portion including a trigger operable to discharge said air pump;

at least one launching tube adapted to carry a projectile in readiness for launch and adapted to receive air discharged from said air pump to effect launch of such a projectile;

operative travel of said first portion from said first position to said second position effecting actuation of at least one task selected from the group consisting of cocking said air pump and selecting a projectile to be launched;

said launcher adapted such that a user holding said second portion may press said first portion against a planar surface to relatively move said first portion from said first position to said second position without any member of said second portion extending beyond the plane of said planar surface; and a breech adapted to allow passage of projectiles into firing alignment;

the at least one launching tube having a muzzle positioned within said breech during at least part of an operational cycle of said launcher.

2. The projectile launcher of claim 1 wherein said first portion includes a false barrel structure, forward of said breech, through which said projectiles pass when launched.

3. The projectile launcher of claim 2 wherein:

said second portion includes a false barrel structure that is part of the barrel through which said projectiles pass when launched; and said first portion false barrel structure is movably carried about the exterior of said second portion false barrel structure for motion between said first position and said second position.

4. The projectile launcher of claim 1 wherein:

the at least one launching tube is movable relative to said breech; and said movabilty of said at least one launching tube is adapted to facilitate said passage of projectiles.

5. The projectile launcher of claim 4 including:

projectile holding apparatus adapted to carry a plurality of projectiles available for launch via discharge of said pump;

advancement apparatus adapted to facilitate selection of a projectile to be launched, said selection being automatically performed during said operational cycle of said launcher.

6. The projectile launcher of claim 5 wherein:

said holding apparatus comprises a plurality of the launching tubes; and said air pump is cocked by travel of said first portion from said first position to said second position.

7. The projectile launcher of claim 5 wherein:

said holding apparatus comprises a chamber that holds a plurality of projectiles and said advancement apparatus facilitates engagement of a selected projectile with the at least one launching tube; and said air pump is cocked by travel of said first portion from said first position to said second position.

* * * * *